US005456461A

United States Patent [19]

Sullivan

[11] Patent Number: 5,456,461

[45] Date of Patent: Oct. 10, 1995

[54] BAT FOR BASEBALL AND SOFTBALL WITH AN ATTACHABLE TIP AT THE EXTERIOR END

[76] Inventor: Michael T. Sullivan, 8706 Middle Cross Place, Tampa, Fla.

[21] Appl. No.: 281,032

[22] Filed: Jul. 27, 1994

[51] Int. Cl.[6] ..... A63B 21/00

[52] U.S. Cl. ..... 273/26 B; 273/193 A; 273/273; 273/72 R

[58] Field of Search ..... 273/72 R, 72 A, 273/26 B, 67 R

[56] References Cited

U.S. PATENT DOCUMENTS

| | | | |
|---|---|---|---|
| 3,618,945 | 11/1971 | Kuchav | 273/26 B |
| 4,819,935 | 4/1989 | Dirksing et al. | 273/26 B |
| 4,898,384 | 2/1990 | Beach | 273/26 B |

FOREIGN PATENT DOCUMENTS

| | | | |
|---|---|---|---|
| 2146538 | 4/1985 | United Kingdom | 273/72 R |

OTHER PUBLICATIONS

Bottle Bats: Pictures of Bottle Bats, "The Washington Post", Thursday, Apr. 18, 1974.

*Primary Examiner*—V. Millin
*Assistant Examiner*—Charles W. Anderson

[57] ABSTRACT

A bat for baseball and softball with an attachable tip at the exterior end comprising a cylindrical device having a first inboard portion adapted to be held by a player and a second outboard portion adapted to strike a ball upon swinging of the bat, the inboard end and the outboard portion having a common axis; the inboard portion having an enlarged knob at its end with material over the inboard portion from adjacent to the knob to a location at an intermediate extent of the inboard portion; and the outboard portion being formed with a diameter substantially equal to twice the diameter of the inboard portion with a short tapering section therebetween.

1 Claim, 5 Drawing Sheets

FIG 3
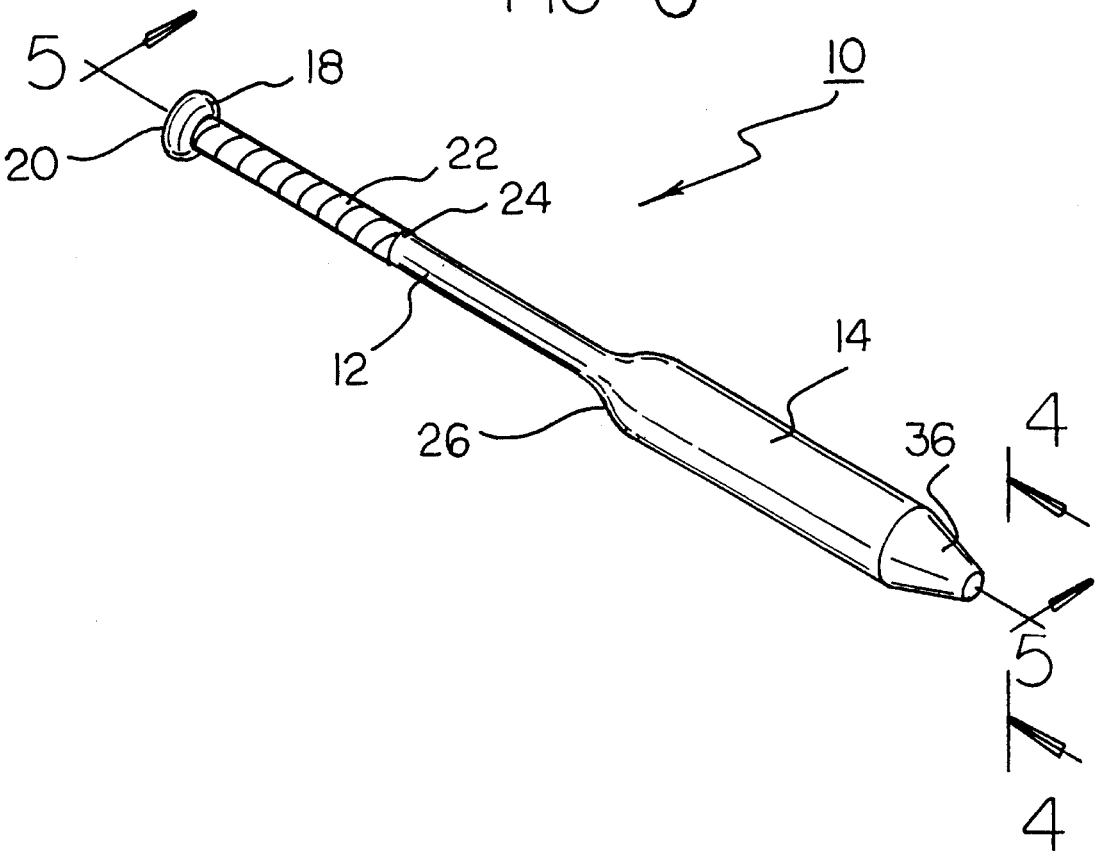
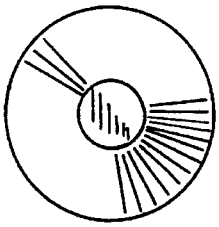
FIG 4

BAT FOR BASEBALL AND SOFTBALL WITH AN ATTACHABLE TIP AT THE EXTERIOR END

BACKGROUND OF THE INVENTION

1. Field of the Invention

The present invention relates to a bat for baseball and softball with an attachable tip at the exterior end and more particularly pertains to providing an aid for hitters in baseball or softball to teach concentration on hitting balls at the sweet spot of the bat only.

2. Description of the Prior Art

The use of baseball bats and softball bats of various designs and configurations is known in the prior art. More specifically, baseball bats and softball bats of various designs and configurations heretofore devised and utilized for the purpose of teaching the art of hitting to baseball players of various degrees of talent and experience through bats configured for such purpose are known to consist basically of familiar, expected, and obvious structural configurations, notwithstanding the myriad of designs encompassed by the crowded prior art which has been developed for the fulfillment of countless objectives and requirements.

By way of example, U.S. Pat. No. Des. 325,612 to Longo discloses a training baseball bat.

U.S. Pat. No. 3,880,423 to Kreag discloses a baseball bat having different striking surfaces.

U.S. Pat. No. 4,682,773 to Pomilia discloses a baseball training bat.

U.S. Pat. No. 4,834,376 to Steinberg discloses a baseball bat with impact indicator.

Lastly, U.S. Pat. No. 5,180,163 to Lanctot discloses a baseball bat.

In this respect, the bat for baseball and softball with an attachable tip at the exterior end according to the present invention substantially departs from the conventional concepts and designs of the prior art, and in doing so provides an apparatus primarily developed for the purpose of providing an aid for hitters in baseball or softball to teach concentration on hitting balls at the sweet spot of the bat only.

Therefore, it can be appreciated that there exists a continuing need for a new and improved bat for baseball and softball with an attachable tip at the exterior end which can be used for providing an aid for hitters in baseball or softball to teach concentration on hitting balls at the sweet spot of the bat only. In this regard, the present invention substantially fulfills this need.

SUMMARY OF THE INVENTION

In view of the foregoing disadvantages inherent in the known types of baseball bats and softball bats of various designs and configurations now present in the prior art, the present invention provides an improved bat for baseball and softball with an attachable tip at the exterior end. As such, the general purpose of the present invention, which will be described subsequently in greater detail, is to provide a new and improved bat for baseball and softball with an attachable tip at the exterior end and method which has all the advantages of the prior art and none of the disadvantages.

To attain this, the present invention essentially comprises a new and improved bat for baseball and softball with an attachable tip at the exterior end comprising, in combination, a cylindrical device having a first inboard portion adapted to be held by a player and a second outboard portion adapted to strike a ball upon swinging of the bat, the inboard end and the outboard portion having a common axis; the inboard portion having an enlarged knob at its end with material over the inboard portion from adjacent to the knob to a location at an intermediate extent of the inboard portion; the outboard portion being formed with a diameter equal to about twice the diameter of the inboard portion with a short tapering section therebetween, the tapering section constituting about five percent of the entire bat, the outboard portion being between about forty five and fifty percent of the length of the entire bat and the inboard portion being between about fifty percent of the entire bat; and an annular recess with interior threads formed at the outboard end of the bat about a common axis with the outboard portion of the bat and an outboardly directed cone shaped tip having an inboardly directed cylindrical extension with external threads adapted to be threaded into the threads at the outboard portion of the bat.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent of legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved bat for baseball and softball with an attachable tip at the exterior end which has all the advantages of the prior art baseball bats and softball bats of various designs and configurations and none of the disadvantages.

It is another object of the present invention to provide a new and improved bat for baseball and softball with an attachable tip at the exterior end which may be easily and efficiently manufactured and marketed.

It is further object of the present invention to provide a new and improved bat for baseball and softball with an attachable tip at the exterior end which is of durable and reliable constructions.

An even further object of the present invention is to provide a new and improved bat for baseball and softball with an attachable tip at the exterior end which is susceptible of a low cost of manufacture with regard to both materials and labor, and which accordingly is then susceptible of low prices of sale to the consuming public, thereby making such a bat for baseball and softball with an attachable tip at the exterior end economically available to the buying public.

Still yet another object of the present invention is to provide a new and improved bat for baseball and softball with an attachable tip at the exterior end which provides in the apparatuses and methods of the prior art some of the advantages thereof, while simultaneously overcoming some of the disadvantages normally associated therewith.

Even still another object of the present invention is to provide an aid for hitters in baseball or softball to teach concentration on hitting balls at the sweet spot of the bat only.

Lastly, it is an object of the present invention to provide a new and improved bat for baseball and softball with an attachable tip at the exterior end comprising a cylindrical device having a first inboard portion adapted to be held by a player and a second outboard portion adapted to strike a ball upon swinging of the bat, the inboard end and the outboard portion having a common axis; the inboard portion having an enlarged knob at its end with material over the inboard portion from adjacent to the knob to a location at an intermediate extent of the inboard portion; and the outboard portion being formed with a diameter substantially equal to twice the diameter of the inboard portion with a short tapering section therebetween.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 3 is a perspective view of the preferred embodiment of the new and improved bat for baseball and softball with an attachable tip at the exterior end constructed in accordance with the principles of the present invention.

FIG. 4 is an end view of the tip of the bat of FIG. 3 taken along line 4—4 of FIG. 3.

The same reference numerals refer to the same parts through the various Figures.

DESCRIPTION OF THE PREFERRED EMBODIMENT

Figure 1:
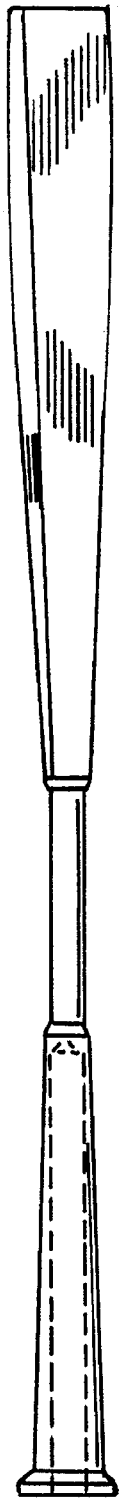
FIG 1 PRIOR ART
FIG. 1 is a front elevational view of a bat of a prior art design.
Figure 2:
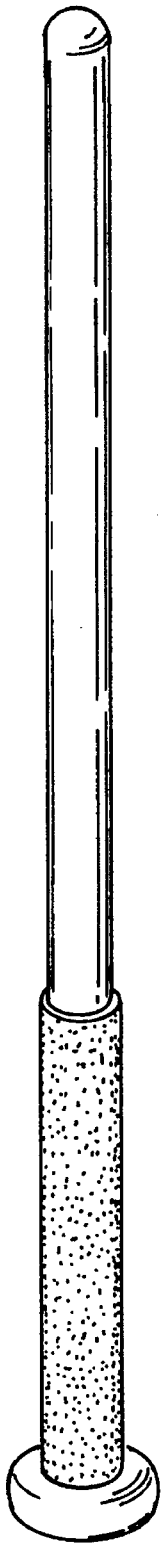
FIG 2 PRIOR ART
FIG. 2 is a perspective illustration of another bat constructed in accordance with a prior art design.
Figure 5:
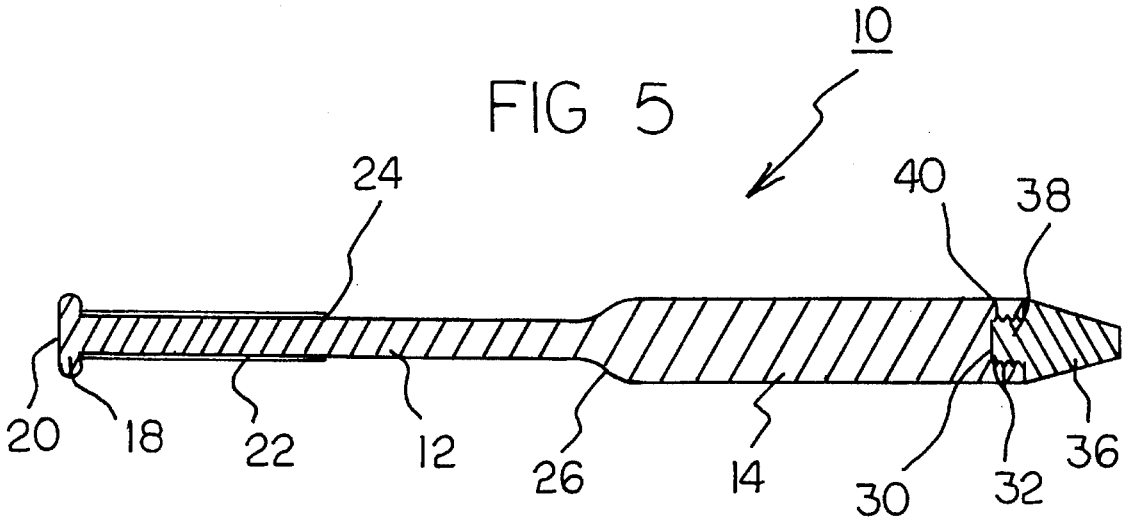
FIG. 5 is a cross sectional view of the bat of FIGS. 3 and 4 taken along line 5—5 of FIG. 3.
Figure 6:
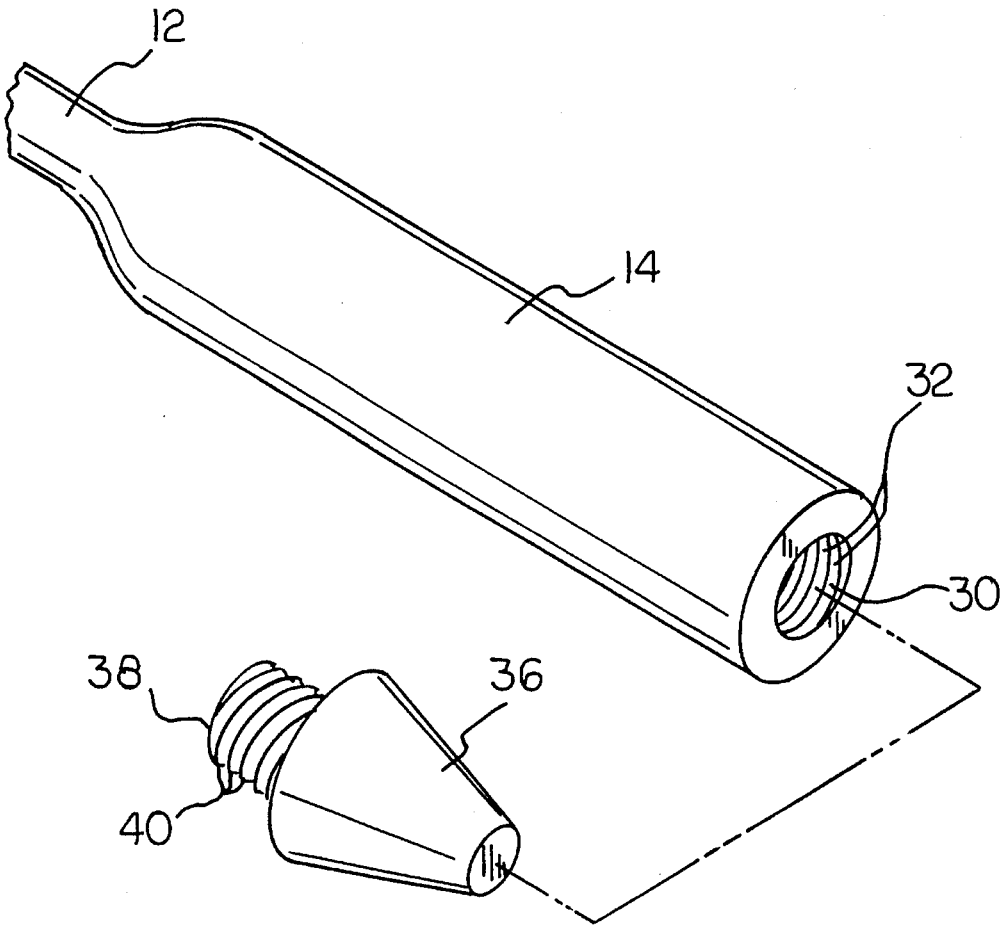
FIG. 6 is an exploded perspective view of the end of the bat illustrated in FIG. 5.

With reference now to the drawings, and in particular to FIG. 1 thereof, the preferred embodiment of the new and improved bat for baseball and softball with an attachable tip at the exterior end embodying the principles and concepts of the present invention and generally designated by the reference numeral 10 will be described.

The present invention, the new and improved bat for baseball and softball with an attachable tip at the exterior end is comprised of a plurality of components. In their broadest context, such components include the bat, an inboard portion, an outboard portion, an annular recess and a removable tip. Such components are individually configured and correlated with respect to each other so as to attain the desired objectives.

More specifically, the bat 10 may be construed as a system. It is adapted for use as a training aid in both baseball and softball. It includes a grip over the majority of the length of the bat and an enlarged head constituting the majority of the length of the bat. It also has a transition portion therebetween. In addition, a removable tip is provided at the exterior end of the bat.

The bat 10 has a first inboard portion 12. This is the handle and is adapted to be held by a player. Also included is a second outboard portion 14 adapted to strike a ball upon swinging of the bat. The inboard portion and the outboard portion are formed about a common axis. Each portion is of a cylindrical configuration.

The inboard portion 12 has an enlarged knob 18 at its end 20. During use, material 22 is placed over the inboard portion to improved the ability of a player to hold it. The material extends adjacent the knob to a location at an intermediate extent 24 of the inboard portion.

Next provided is the outboard portion 14. Such outboard portion is formed with a diameter equal to about twice the diameter of the inboard portion. Also included is a short tapering section 26 between the inboard portion and the outboard portion. The tapering section constitutes about five percent of the length of the bat. The outboard portion is between about forty-five and fifty percent of the length of the entire bat. The inboard section is about fifty percent of the length of the entire bat.

An annular recess 30 is formed at the outboard end of the bat. Such recess is formed with internal thread 32. Such recess is formed about a common axis with the outboard portion of the bat.

Cooperable with the recess is an outboardly directed cone shaped tip 36. Such tip has an inboardly directed cylindrical extension 38. Such extension is provided with external threads 40. The external threads are adapted to be cooperatively mated into the threads at the outboard end of the bat. This is to add additional weight to the bat in an area for increasing its effectiveness as a batting aid.

Figure 7:
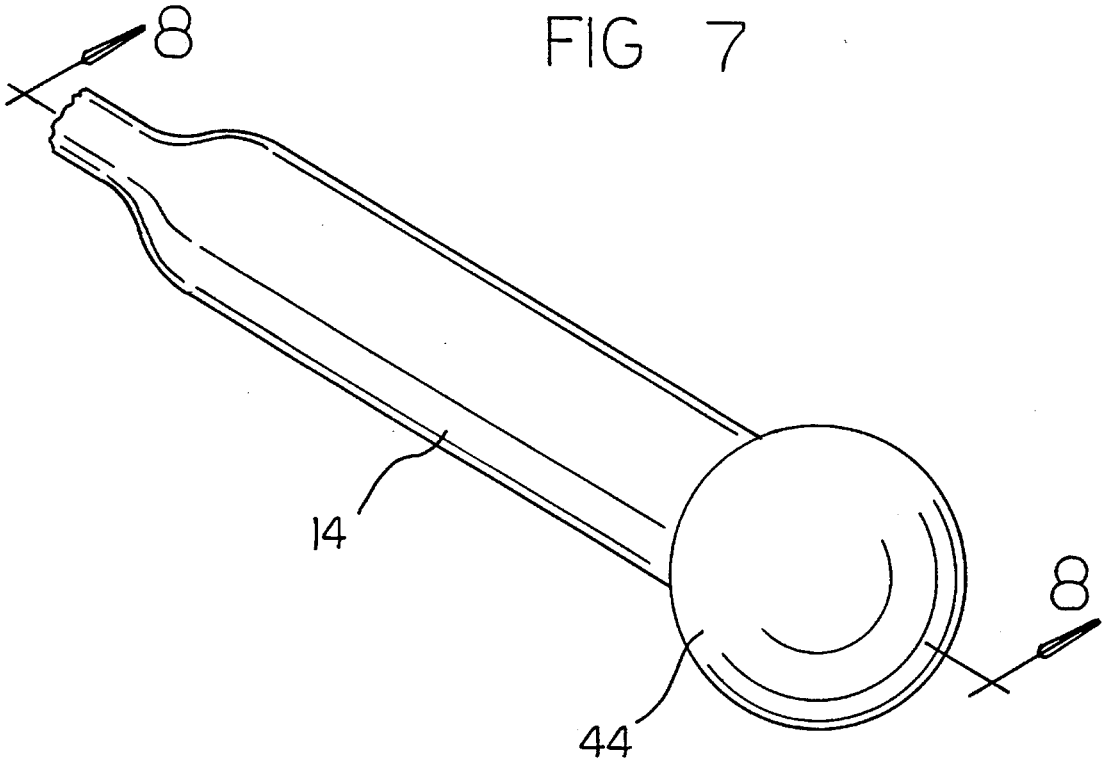
FIG. 7 is a perspective view of the end of the bat illustrating an alternate embodiment of the invention.
Figure 8:
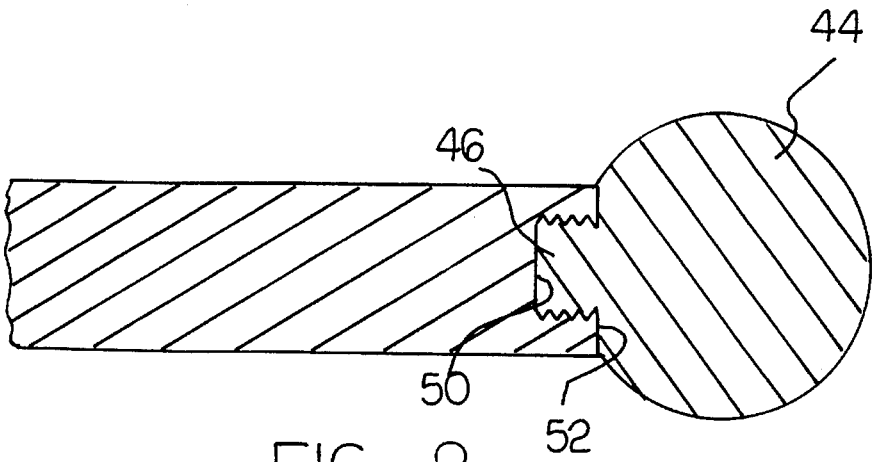
FIG. 8 is a cross sectional view taken along line 8—8 of FIG. 7.

An alternate embodiment of the invention is shown in FIGS. 7 and 8. In such embodiment, the cone shaped tip is replaced by a tip in the shape of a ball, an essentially spherical shaped tip 44. The inwardly projecting extension 46 and associated threads 48 in a recess 50 at the outboard end 52 of the outboard portion are essentially the same as that in the first embodiment. The ball shaped projection provides a slightly different aerodynamic resistance during a swing than does the cone shaped projection. This selection is a matter of choice of the user, either the student learning to hit or the teacher of the student.

Figure 9:
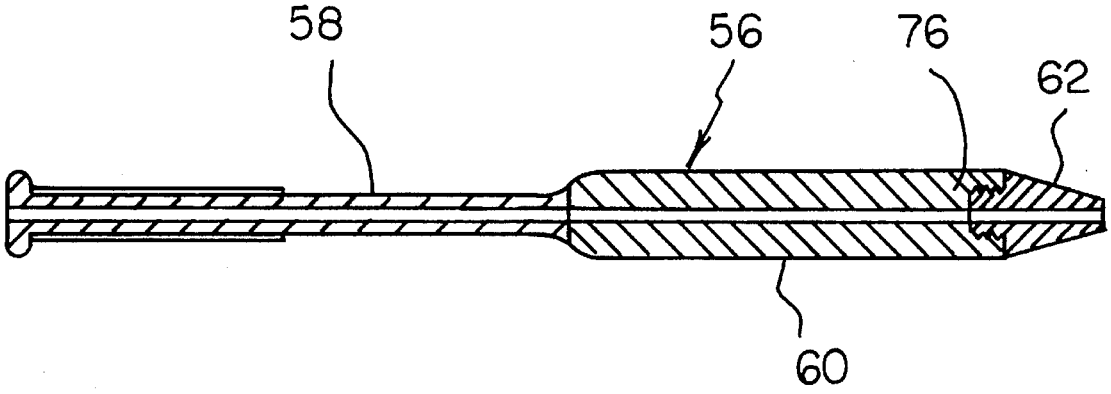
FIG. 9 is a cross sectional view of a further alternate embodiment of the invention.
Figure 10:
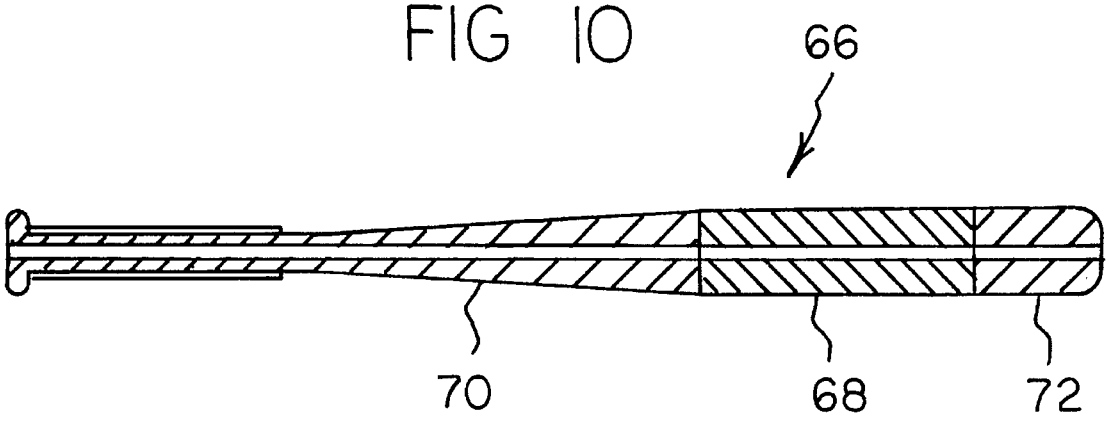
FIG. 10 is a cross sectional view of a still further alternate embodiment of the invention.

Alternate embodiments are shown in FIGS. 9 and 10. In the FIG. 9 embodiment, the bat 56 is made up of three portions, an interior portion 58, an intermediate portion 60 and an exterior portion 62. In such embodiment, the sweet spot is located in the intermediate portion 60 of the bat 56 it is made up of a different material than the remainder of the bat including the interior and exterior sections 58 and 62. In the preferred embodiment, the intermediate section is made up of a composite material such as carbon or graphite fibers in a matrix binder. Such an intermediate section would make a loud, different, distinct noise from the remainder of the bat or bats of other material when hitting a ball. Aluminum and similar metal alloys make a more dull noise. The other sections of the bat on opposite sides of the intermediate section are made up of more conventional metals such as aluminum, steel or alloy metals. This is helpful to the bat in giving it sound effects that are very distinctive as a function of where the ball is hit. As a result, when the ball is hit on the sweet spot as intended such will be known due to the sound that is made.

A further variation of this embodiment is shown in FIG. 10 wherein bat 66 is formed with an intermediate or sweet spot section 68 of composite materials as described above with respect to the FIG. 9 embodiment. The interior section 70 and exterior section 72 are made up of conventional materials such as aluminum, steel or conventional alloys exhibiting a different sound from that of the sweet spot. The difference between the FIG. 10 embodiment and that of FIG. 9 is that the various sections of the bat are permanently coupled one with respect to the other. In the FIG. 9 embodiment, the exterior section 62 is coupled to the intermediate section 60 through associated screw threads 76 which allow for the removable coupling therebetween for varying the weight of the bat. In those embodiments, particularly those in FIGS. 9 and 10, the various sections of the bat are made hollow as is conventional in the art.

The bat may be made of any material suitable for the purpose. A solid wooden bat including a solid wooden tip is readily acceptable. In the alternative, a hollow bat fabricated of metal such as aluminum or of a composite material could also be utilized. In addition, the major portion of the bat could be fabricated of one material and the tip of another. In any of these configurations, the overall concept of the bat shape is the same for effecting the attended objective.

The present invention is a training aid. It teaches players how to hit a pitched baseball on the part of the bat that produces the best results. Golfers often talk about hitting the ball on the sweet spot of the club and sending it a mile down the fairway. Baseball players also understand that when the ball is struck with a certain portion of the bat, the results are equally outstanding. That portion is related to the flexural center of the bat, but the players have no way of knowing just where on the bat it is located. Many early players associated it with the trademark which was burned into the bat at the widest part. This invention provides a practice bat which clearly defines the position of the sweet spot.

This practice aid has a handle which is identical to standard bats, and the barrel has a similar small diameter except for the portion which contains the flexural center. That section has a diameter which is equal to the hitting portion of a standard bar, but is substantially shorter in length. If the ball is not struck by that section, the results are decidedly unacceptable. Using this bat in practice will help to develop concentration, perfect the mechanics of the swing,.and gain a keen eye. In addition, the location of the plate becomes ingrained in the player's mind, so they do not swing at balls that are out of the strike zone.

The present invention is made of aluminum and is balanced like a standard bat. The narrow diameter portions of this bat are reinforced to add extra strength. It is produced in various lengths, weights and grip sizes. The sweet area is black to contrast with the white baseball to enable the hitter to see the ball make contact with the bat.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A new and improved bat for baseball and softball with an attachable tip at the exterior end comprising, in combination:

a cylindrical device having a first inboard portion adapted to be held by a player and a second outboard portion adapted to strike a ball upon swinging of the bat, the inboard end and the outboard portion having a common axis;

the inboard end being formed with a cylindrical configuration having a circular cross section of a common diameter for about 5090 of the length of the device, the inboard portion having an enlarged knob at its end with material over the inboard portion from adjacent to the knob to a location at an intermediate extent of the inboard portion;

the outboard portion being formed with a diameter equal to about twice the diameter of the inboard portion with a short tapering section therebetween, the tapering section constituting about five percent of the entire bat, the outboard portion being between about forty five and fifty percent of the length of the entire bat and the inboard portion being about fifty percent of the entire bat; and an annular recess with interior threads formed at the outboard end of the bat about a common axis with the outboard portion of the bat and an outboardly directed cone shaped tip having an inboardly directed cylindrical extension with external threads adapted to be threaded into the threads at the outboard portion of the bat., the tip and the outboard portion being of a common exterior diameter and an area of contact therebetween.

* * * * *